US006817661B2

(12) United States Patent
Zheng

(10) Patent No.: US 6,817,661 B2
(45) Date of Patent: Nov. 16, 2004

(54) COLLAPSIBLE CHAIR WITH SLIDING RIGID ARMREST

(76) Inventor: Edward Zheng, 876 Everset Dr., Chino Hills, CA (US) 91709

( * ) Notice: Subject to any disclaimer, the term of this patent is extended or adjusted under 35 U.S.C. 154(b) by 0 days.

(21) Appl. No.: 10/301,443

(22) Filed: Nov. 20, 2002

(65) Prior Publication Data

US 2004/0094997 A1 May 20, 2004

(51) Int. Cl.[7] ..... A47C 4/00
(52) U.S. Cl. ..... 297/16.1; 297/27; 297/19
(58) Field of Search ..... 297/19, 21, 22, 297/27, 35, 38, 39, 16.2, 46; 403/13, 14, DIG. 13

(56) References Cited

U.S. PATENT DOCUMENTS 571,823 A * 11/1896 Briggs ..... 297/21
770,852 A * 9/1904 Grover ..... 297/38
1,007,813 A * 11/1911 Stone ..... 297/19
1,876,479 A * 9/1932 Weller ..... 297/19
2,195,091 A * 3/1940 Lorenz et al. ..... 297/27
2,507,023 A * 5/1950 Lee ..... 297/19
2,697,476 A * 12/1954 Tripodi ..... 297/18
5,570,926 A * 11/1996 Papiernik et al. ..... 297/39
6,517,151 B2 * 2/2003 Liu ..... 297/16.1
6,601,912 B1 * 8/2003 Chen ..... 297/45

FOREIGN PATENT DOCUMENTS

FR 2530438 A1 * 1/1984 ..... A47C/4/16

* cited by examiner

*Primary Examiner*—Peter M. Cuomo
*Assistant Examiner*—Stephanie Harris
(74) *Attorney, Agent, or Firm*—Rutan & Tucker

(57) ABSTRACT

A chair with rigid armrest collapses in a single movement in which the front legs of the chair approximate each other as the front legs and the rear legs pivot towards each other, and in which the armrest slidingly moves relative to the front leg.

10 Claims, 1 Drawing Sheet

FIG. 1
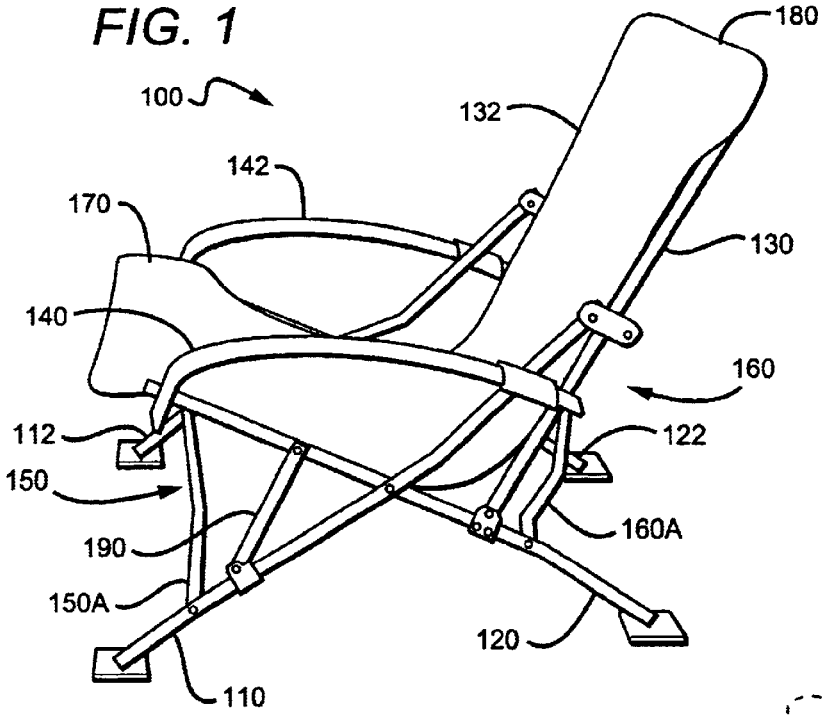
FIG. 2
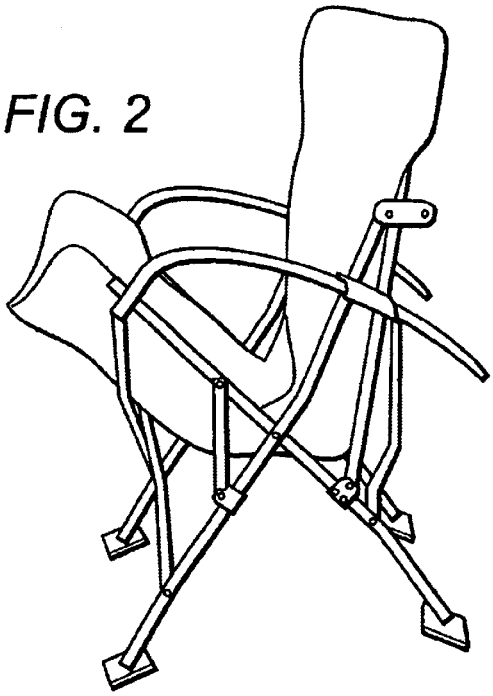
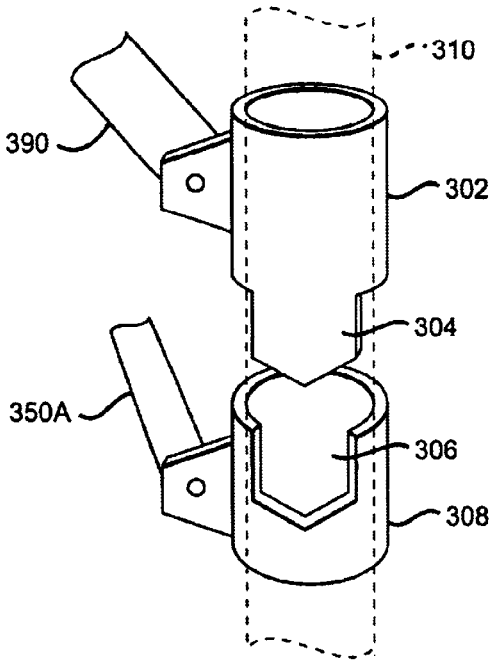
FIG. 3

COLLAPSIBLE CHAIR WITH SLIDING RIGID ARMREST

FIELD OF THE INVENTION

The field of the invention is collapsible furniture.

BACKGROUND OF THE INVENTION

Folding chairs are relatively popular, in part because they can be stored at considerably reduced space requirements when compared to non-folding chairs. Exemplary folding chairs with rigid arm rests and seat support rods are described in U.S. Pat. No. 4,613,185 to Marchesini et al. (Sep. 23, 1986), U.S. Pat. No. 5,899,525 to Tseng (May 4, 1999), U.S. Pat. No. 5,947,553 to Tseng (Sep. 7, 1999), and U.S. Pat. No. 6,062,639 to Hill (May 16, 2000), all of which are incorporated by reference herein.

Nevertheless, previously known folding chairs still take up a relatively large space when folded, since the dimension of the folding chair is generally reduced only along one space coordinate (e.g., reduced length). To further reduce the space requirement, collapsible chairs have been developed in which further size reduction is achieved by folding the chair along at least two space coordinates (e.g., length and width). Various collapsing chairs are known in the art.

In U.S. Pat. No. Des 247,618 (Mar. 28, 1978), for example, Sparkes describes a collapsible stroller with rigid armrests and seat support rods that is first folded in a front to back motion and then folded in a side-to-side motion. Although Sparkes' stroller provides substantial space saving over non-collapsible strollers, the collapsing is relatively cumbersome since both halves of the chair have to be rotated relative to each other. Improved collapsibility can be achieved by including a detachable connector element into a structure that couples foldable halves of the stroller as described in U.S. Pat. No. 4,317,581 to Kassai (Mar. 2, 1982). Uncoupling of the detachable element advantageously simplifies side-to-side folding of the stroller. However, Kassai's stroller nevertheless requires at least two folding operations to collapse the stroller.

To avoid at least some of the problems associated with multiple operations of collapsible chairs, Mann describes in U.S. Pat. No. 5,058,950 (Oct. 22, 1991) the use of hinges in both armrests and seat support rods. Mann's chair can be collapsed in a single side-to-side and front-to-back motion, however, the hinges in the armrests may be uncomfortable for at least some of the users. Moreover, due to the particular configuration of movable elements in the chair, front and back seat support rods are perpendicular to the legs of a person sitting in the chair, which will likely restrict blood flow in the legs of almost all users over a prolonged period.

Although there are various collapsible chairs with rigid armrests known in the art, all or almost all of them suffer from one or more disadvantages. Therefore, there is a need to provide improved methods and apparatus for collapsible chairs with rigid armrests.

SUMMARY OF THE INVENTION

The present invention is directed to collapsible chairs with rigid armrests, and especially to those in which the slid armrest is slidably coupled to the front leg, rear leg, and/or back support rod.

In one aspect of the inventive subject matter, contemplated chairs include a front leg rotatably coupled to a rear leg, a back support rod pivotably coupled to the rear leg, a seat coupled to the rear leg, and a rigid armrest slidably coupled to the front leg, such that the chair collapses in a single movement. Such chairs may further comprise a first cross brace and a second cross brace, wherein the first cross brace is coupled to the front leg and a second rear leg, and wherein the second cross brace is coupled to the rear leg and a second seat support rod such that the chair collapses in a single movement in which the front legs approximate each other as the front legs and the rear legs pivot towards each other.

In still further aspects of contemplated chairs, an auxiliary rod may be rotatably coupled to the rear leg and slidably and rotatably coupled to the front leg, wherein the auxiliary rod may further engage with the first cross brace when the chair is in an open configuration. The back rest is preferably coupled to the back support rod (and may be contiguous with the seat), while the armrest in preferred chairs has an arcuate shape.

In another aspect of the inventive subject matter, contemplated chairs may include a pair of front legs, a pair of rear legs, a pair of back support rods, a pair of rigid arm rests, a first pair of cross braces, and a second pair of cross braces, wherein each of the front legs is rotatably coupled to each of the rear legs, respectively, wherein each of the back support rods is pivotably coupled to each of the rear legs, respectively, wherein each of the rigid armrests is slidably coupled to each of the front legs. Such chairs may further include a seat coupled to the rear legs, and a back rest coupled to the back support rods, wherein the seat and the back rest are contiguous, wherein one cross brace of the first pair of cross braces is rotatably coupled to one of the front legs and rotatably coupled to one of the rear legs, and wherein one cross brace of the second pair of cross braces is rotatably coupled to one of the rear legs and rotatably and slidably coupled to one of the back support rods.

Various objects, features, aspects and advantages of the present invention will become more apparent from the following detailed description of preferred embodiments of the invention, along with the accompanying drawings in which like numerals represent like components.

BRIEF DESCRIPTION OF THE DRAWINGS

FIG. 1 is a perspective view of an exemplary collapsible chair according to the inventive subject matter in open configuration.

FIG. 2 is a perspective view of the chair of FIG. 1 in partially collapsed configuration.

FIG. 3 depicts an exemplary engagement of an auxillary rod with a cross brace.

DETAILED DESCRIPTION

It is generally contemplated that a collapsible chair includes a seat coupled to a pair of rear legs and a rigid arm rest slidably coupled to at least one of the front legs, the rear legs, and/or the back support rods, and that the chair can be collapsed in a single motion. As used herein, the term "collapses in a single movement" or "collapses in a single motion" are used interchangeably and refer to a movement in which a user need not interrupt the collapsing motion to fasten or unfasten a connector. Thus, the term "collapses in a single movement" may also include multiple sub-movements, which may or may not be separated by a pause.

In one aspect of the inventive subject matter as depicted in FIG. 1, a collapsible chair 100 has a pair of front legs 110 and 112, a pair of rear legs 120 and 122, a pair of back support rods 130 and 132, a pair of rigid arm rests 140 and 142 (preferably having arcuate shape), a first pair of cross braces 150, and a second pair of cross braces 160. Chair 100 further includes a seat 170 that is coupled to the rear legs 120 and 122, and a back rest 180 contiguous with the seat 170 and coupled to the back support rods 130 and 132. An auxiliary rod 190 is rotatably coupled to rear leg 120 and slidably and rotatably coupled to front leg 110, and on the opposite side of the chair, auxiliary rod 192 (not shown) is rotatably coupled to rear leg 122 and slidably and rotatably coupled to front leg 112.

In a particularly preferred aspect, each of the front legs 110 and 112 is rotatably coupled to each of the rear legs 120 and 122, respectively. Most preferably, such coupling is located at about mid-point of each of the front and rear legs. Furthermore, each of the back support rods 130 and 132 is pivotably coupled to each of the rear legs, respectively. Most preferably, such coupling is located between the coupling point of the front and rear legs and the end of the rear leg that supports the chair on the ground (when the chair is in an open configuration). Each of the armrests 140 and 142 is slidably coupled to each of the front legs 110 and 112, respectively, wherein coupling is most preferably achieved via a sleeve through which the rigid arm rest slides, wherein the sleeve is rotatably (and optionally slidably) coupled to the front leg. On the opposite end of the arm rest, it is generally preferred that the arm rest is rotatably coupled to the rear leg (and most preferably at the point on the rear leg that is opposite the end of the rear leg that supports the chair on the ground (when the chair is in an open configuration)). In still further preferred aspects, the front leg is pivotably and slidably coupled to the back support rod at the end of the front leg that is opposite the end of the front leg that supports the chair on the ground (when the chair is in an open configuration).

One cross brace 150A of the first pair of cross braces 150 is rotatably coupled to front leg 110 and rotatably coupled to rear leg 122, while the other cross brace 150B (not shown) of the first pair of cross braces 150 is rotatably coupled to front leg 112 and rotatably coupled to rear leg 120. Similarly, one cross brace 160A of the second pair of cross braces 160 is rotatably coupled to rear leg 120 and rotatably and slidably coupled to back support rod 132, while the other cross brace 160B (not shown) of the second pair of cross braces 160 is rotatably coupled to rear leg 122 and rotatably and slidably coupled to back support rod 130. For better illustration, FIG. 2 depicts the exemplary collapsible chair of FIG. 1 in a semi-collapsed configuration.

In further especially preferred aspects, auxiliary rod 190 engages with cross brace 150A when the chair is in an open configuration, wherein in an exemplary configuration engagement takes place by sliding (and eventually pressing) the sleeve that couples the auxiliary rod to the front leg against cross brace 150A (and most typically against an coupling element that rotatably couples cross brace 150A to the front leg). Such engagement is thought to stabilize the upper end of the rear legs that operate as seat supporting rods when the chair is in an open configuration.

A particularly preferred engagement of auxiliary rod 190 with cross brace 150A is depicted in FIG. 3 in which a connector 302 is slidably coupled to front leg 310, and wherein the connector 302 has a protrusion 304 that matingly engages with a corresponding indentation 306 in connector 308 that is fixed to the front leg 310. Connector 302 further pivotably and/or rotatably couples auxiliary rod 390 to the front leg, while connector 308 further pivotably and/or rotatably couples cross brace 350A to the front leg. Thus, it should be recognized that when the auxiliary rod engages with the cross brace via connectors 301 and 308, the protrusion and corresponding indentation will not only provide for a defined fit relative to the sliding engagement (i.e., front-to-back), but also prevent rotating of the slidable connector along the longitudinal axis of the front leg. Consequently, when the auxiliary rod engages with the cross brace, additional stability is imparted into the chair.

With respect to the protrusion and the corresponding indentation, it should be recognized that numerous forms other than that depicted in FIG. 3 are also appropriate, and it is generally contemplated that all protrusions that—when matingly engaged with the corresponding indentation(s)—are deemed suitable for use herein. For example, a connector may have one or more protrusions, which may have a shape that facilitates engagement with the corresponding indentation(s). Similarly, the protrusion may be of any shape (e.g., wave-shaped, irregularly shaped, serrated, etc.).

Still further, it should be appreciated that the connector 302 may have an indentation that matingly engages or otherwise receives a protruding element that may be coupled to a chair. In such configurations, it should be recognized that the second connector (corresponding to 308 in FIG. 3) may be omitted. For example, the connector (corresponding to 302 in FIG. 3) may have a cutout that receives a pin or otherwise extending element that is coupled to a leg (or other element of the chair), wherein the pin may act exclusively for securing the connector, or wherein the pin may be part of a connector (e.g., L-shaped connector that couples a cross brace or other element to the chair).

Of course it should be appreciated that the use of such connectors need not be limited to the exemplary chair presented herein, but may be employed with all collapsible furniture that includes a pair of connectors coupled to a first furniture element (e.g., front leg, rear leg, seat support rod, back support rod, cross brace), in which at least one of the connectors (or both of the connectors) is slidingly coupled to the first furniture element, and wherein at least one, and more typically both of the connectors rotatably, pivotably, or slidably couples at least one other furniture element to the first furniture element via the respective connector. Exemplary suitable collapsible furniture pieces for use in conjunction with contemplated connectors include those described in copending PCT applications with the Ser. Nos. PCT/US00/23989, PCT/US00/41982, PCT/US00/33112, PCT/US01/07821, PCT/US00/41981, and PCT/US01/06892, and copending U.S. applications with the Ser. Nos. 10/025,361 and 10/041,962, all of which are incorporated by reference herein.

It is especially contemplated that the seat and the backrest are fabricated from a weather resistant material or fabric, preferably a woven synthetic polymer (e.g., Nylon) and is uniformly colored (e.g., blue). Particularly preferred seats have a width of about 26 inches and an overall length of about 28 inches. However, it should be appreciated that various alternative materials, colors, and sizes are also appropriate.

For example, alternative materials may include natural and synthetic fabrics and all reasonable combinations thereof. Contemplated materials may further be woven or non-woven and particularly contemplated materials include polyester, polyvinyl chloride, cotton, hemp, and wool. With respect to the color, it is contemplated that suitable colors need not be restricted to uniform color, but appropriate colors may also include color patterns, prints, no color at all. While it is generally preferred that the chair according to the inventive subject matter is sized and dimensioned to fit an average adult person, it is also contemplated that appropriate chairs may also accommodate a child, a smaller- or larger-than-average adult, or more than a single person. Therefore, alternative chairs may have dimensions that are wider than 26 inches, and suitable widths include 26–28, 28–30, and 30–40 inches, and wider, but also 20–26, 15–20, and 12–15 inches, and narrower. Likewise, the length of appropriate seats may vary between 28–24, 24–18, and 12–18 inches and less, but also between 28–30, 30–35, and more. It should further be appreciated that contemplated seats may also be tapered from the front end to the back end, or vice versa.

With respect to the backrest it is contemplated that all materials suitable for the seat are also suitable for the backrest, and it is generally preferred that the backrest is fabricated from the same material as the seat. It is further contemplated that the backrest is removably or permanently coupled to the seat (e.g., sewed, coupled with a zipper, etc.) Thus, it is preferred that the backrest has a width of about 26 inches. A preferred height of the backrest is about 24 inches. With respect to the material and color, it is contemplated that the same considerations as for the seat apply. It is further contemplated that the width and height of suitable backrests may vary, and that width and height will depend among other things on the persons' size and the number of persons to be seated in the chair. Thus, alternative backrests may have a width between 18–26 inches and less, but also between 26–33 and more. Similarly, contemplated backrests may have a height between 12–24 inches and less, but also between 24–30 inches and more.

It is generally contemplated that the seat and the backrest may be coupled to the rear legs and back support rods in numerous ways, including temporary and permanent coupling. Temporary couplings include hook-and-loop type fasteners, snaps, buckles, slidable elements (e.g., a pouch slidably coupled to a post, a ring slidably coupled to a rod, etc.), and threadably securable elements (e.g., laces threaded through rings). Permanent couplings include sewed or glued elements. For example, the backrest may permanently coupled to the chair via a rivet. On the other hand, the front end of the seat may be temporarily coupled to the rear legs via ring-shaped openings that are slid over the top ends of the rear legs. It is further particularly preferred that the seat and the backrest are coupled together to form a continuous supporting surface.

It should further be appreciated that the attachment of the seat and/or the backrest to the chair may be directly or indirectly. As used herein, the term "direct" attachment means that the seat and/or the backrest are in immediate contact with the supporting structure, whereas the term "indirect" means that an additional element connects the seat and/or backrest with the supporting structure. For example, the seat may be directly attached to the rear legs via a slidable pouch. Alternatively, the seat may be indirectly coupled to the rear legs via a ring-shaped opening in the seat that slidably engages with the rear legs.

With respect to the front and rear legs, arm rests, back support rods, auxiliary support rods, and cross braces of contemplated chairs, it should be appreciated that all of these elements may be manufactured from various materials, including metals, metal alloys, natural and synthetic polymers, and any reasonable combination thereof. However, it is preferred that the legs, back support rods, auxiliary support rods, and cross braces are manufactured from black anodized aluminum tubing with a wall strength of about 1/32 inch and an outer diameter of approximately ½ inch. It is also preferred that the rigid armrest is fabricated from a recycled molded thermoplastic polymer, and especially preferred alternative materials for the armrest, legs, support rods, and cross braces include stainless steel, fiberglass, and wood. As used herein, the term "rigid armrest" means that the armrest is fabricated from a sufficiently stiff material to substantially maintain the shape of the armrest while the chair is being folded or unfolded. For example, a wooden, plastic, or metal armrest is considered a rigid armrest under the scope of this definition, because such armrests are fabricated from a material with sufficient stiffness to maintain the shape of the armrest. In contrast, a woven or textile armrest, is not considered a rigid armrest under the scope of this definition because such armrests will deform (i.e. change their shape) while the chair is folded or unfolded.

Where at least one of the armrests, front or rear legs, back support rods, and cross braces are rotatably or pivotally coupled to another one of the armrests, front or rear legs, back support rods, and cross braces, it is generally contemplated, that all known manners of rotatably coupling are suitable for use in conjunction with the teachings presented herein. For example, appropriate manners of rotatably coupling include coupling of two elements via a common axis, coupling via a hinge wherein the hinge may or may not have a slidable connection to another element, coupling via a ball bearing, etc. Similarly, where one of the armrests, front or rear legs, back support rods, and cross braces are slidably coupled to another one of the armrests, front or rear legs, back support rods, and cross braces, all known slidable couplings are contemplated to be appropriate, and include a sliding sleeve, slide rails, guiding rings, etc.

It should further be recognized that contemplated couplings may be realized in various configurations. For example, rotatable couplings may include couplings that are also slidable relative to their point of attachment. For example, contemplated alternative rotatable couplings may include a sleeve that is slidably coupled. Thus, it should be appreciated that contemplated couplings may be rotatable and slidable. Alternatively, where rotatable and slidable couplings are less desirable, temporary couplings may be employed and suitable temporary couplings include snap connectors, connectors that are secured with a pin or other removable element, etc.

It is generally contemplated that the armrests, front and rear legs, back support rods, and cross braces are coupled in a manner that allows collapsing the chair in a single movement, e.g., such that the front legs approximate each other as the front legs and the rear legs pivot towards each other. As viewed from another perspective, the seat pivots upwardly and the rear legs leg pivot towards the pair of front legs, as the chair folds into a closed configuration.

In still further alternative aspects of the inventive subject matter the number of front legs, rear legs, back support rods, and/or cross braces may vary considerably. For example, where the chair is sized and dimensioned to accommodate more than one person, three, four, or more front and/or rear legs, and/or cross braces may be included. On the other hand, where stability of the seat is particularly desirable, additional seat support rods may be included in a chair with two front legs and two rear legs. Likewise, the number of cross braces may vary, and while some chairs may have only one pair of cross braces, other chairs may include three, four, or more cross braces.

Consequently, and viewed from another perspective, a collapsible chair may include a front leg that is rotatably coupled to a rear leg, a back support rod that is pivotably coupled to the rear leg, a seat coupled to the rear leg, and a rigid armrest slidably coupled to the front leg, such that the chair collapses in a single movement. Particularly preferred collapsible chairs will further comprise a first cross brace and a second cross brace, wherein the first cross brace is coupled to the front leg and a second rear leg, and wherein the second cross brace is coupled to the rear leg and a second seat support rod such that the chair collapses in a single movement in which the front legs approximate each other as the front legs and the rear legs pivot towards each other.

In still further contemplated aspects of the inventive subject matter, suitable chairs may further comprise an auxiliary rod that is rotatably coupled to the rear leg and slidably and rotatably coupled to the front leg, and it is particularly preferred that the auxiliary rod engages with the first cross brace when the chair is in an open configuration. With respect to the seat, back rest, armrest, and other components, the same considerations as described above apply. However, it is generally preferred that the back rest is coupled to the back support rod and is contiguous with the seat, and that the rigid armrest has an arcuate shape.

Thus, specific embodiments and applications of collapsible chairs with sliding rigid armrest have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A collapsible chair comprising:

a front leg rotatably coupled to a rear leg, a back support rod pivotably coupled to the rear leg, a seat coupled to the rear leg, and a rigid armrest slidably coupled to the front leg, such that the chair collapses in a single movement;

a first cross brace and a second cross brace, wherein the first cross brace is coupled to the front leg and a second rear leg, and wherein the second cross brace is coupled to the rear leg and a second back support rod such that the chair collapses in a single movement in which the front legs approximate each other as the front legs and the rear legs pivot towards each other; and further comprising an auxiliary rod that is rotatably coupled to the rear leg and slidably and rotatably coupled to the front leg.

2. The collapsible chair of claim 1 wherein the auxiliary rod engages with the first cross brace when the chair is in an open configuration.

3. The collapsible chair of claim 1 further comprising a back rest that is coupled to the back support rod.

4. The collapsible chair of claim 3 wherein the back rest is contiguous with the seat.

5. The collapsible chair of claim 4 wherein the rigid armrest has an arcuate shape.

6. A collapsible chair, comprising:

a pair of front legs, a pair of rear legs, a pair of back support rods, a pair of rigid arm rests, a first pair of cross braces, and a second pair of cross braces;

wherein each of the front legs is rotatably coupled to each of the rear legs, respectively, wherein each of the back support rods is pivotably coupled to each of the rear legs, respectively, wherein each of the rigid armrests is slidably coupled to each of the front legs;

a seat coupled to the rear legs, and a back rest coupled to the back support rods, wherein the seat and the back rest are contiguous;

wherein one cross brace of the first pair of cross braces is rotatably coupled to one of the front legs and rotatably coupled to one of the rear legs;

wherein one cross brace of the second pair of cross braces is rotatably coupled to one of the rear legs and rotatably and slidably coupled to one of the back support rods; and further comprising an auxiliary rod rotatably coupled to one of the rear legs and slidably and rotatably coupled to one of the front legs, wherein the auxiliary rod engages with the one cross brace of the first pair of cross braces when the chair is in an open configuration.

7. The collapsible chair of claim 6 wherein at least one of the rigid arm rests has an arcuate shape.

8. The collapsible chair of claim 6 wherein at least one of the rigid arm rests is manufactured from a polymer or metal.

9. The collapsible chair of claim 6 wherein at least one of the front legs, the rear legs, the back support rods, and the cross braces is manufactured from a metal.

10. The collapsible chair of claim 6 wherein the seat and the back rest are manufactured from a weather resistant material.

* * * * *